US012753482B2

(12) United States Patent
Wang et al.

(10) Patent No.: US 12,753,482 B2
(45) Date of Patent: Oct. 6, 2026

(54) PRE-OXIDIZED, COATING-FREE PRESS HARDENED STEEL

(71) Applicant: GM Global Technology Operations LLC, Detroit, MI (US)

(72) Inventors: Zhou Wang, Shanghai (CN); Zhao Li, Shanghai (CN); MingFeng Shi, West Bloomfield, MI (US); Sarah Tedesco, Novi, MI (US); Jianfeng Wang, Shanghai (CN); Jiachen Pang, Shanghai (CN); Zhen Chen, Shanghai (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1 day.

(21) Appl. No.: 18/917,542

(22) Filed: Oct. 16, 2024

(65) Prior Publication Data

US 2026/0092350 A1 Apr. 2, 2026

(30) Foreign Application Priority Data

Sep. 30, 2024 (CN) ..... 202411391304.5

(51) Int. Cl.

| | |
|---|---|
| ***C22C 38/02*** | (2006.01) |
| ***B32B 15/04*** | (2006.01) |
| ***C22C 38/04*** | (2006.01) |
| ***C22C 38/48*** | (2006.01) |
| ***C22C 38/58*** | (2006.01) |

(Continued)

(52) U.S. Cl.

CPC ..... *C23C 8/10* (2013.01); *C21D 1/673* (2013.01); *C22C 38/02* (2013.01); *C22C 38/04* (2013.01); *C22C 38/48* (2013.01); *C22C 38/58* (2013.01)

(58) Field of Classification Search

CPC ..... B32B 15/04; C22C 38/02; C22C 38/04; C22C 38/48; C22C 38/58

USPC ..... 428/472.2

See application file for complete search history.

(56) References Cited

U.S. PATENT DOCUMENTS

| | | | | |
|---|---|---|---|---|
| 2021/0222265 | A1* | 7/2021 | Lu | C21D 6/008 |
| 2023/0235424 | A1 | 7/2023 | Lu et al. | |
| 2024/0139875 | A1 | 5/2024 | Coryell et al. | |

FOREIGN PATENT DOCUMENTS

| | | | |
|---|---|---|---|
| DE | 202012000616 | U1 | 2/2012 |
| EP | 2128295 | A1 | 12/2009 |

(Continued)

OTHER PUBLICATIONS

"Hochtemperaturkorrosion / Schutzschichten", "Spektrum der Wissenschaft", Uni Regensburg (1998), https://hps.hs-regensburg.de/heh39273/aufsaetze/ht_korr1.pdf.

(Continued)

*Primary Examiner* — Katherine A Christy
(74) *Attorney, Agent, or Firm* — Vivacqua Crane, PLLC

(57) ABSTRACT

A pre-oxidized steel sheet for press hardening, a press hardened, pre-oxidized steel sheet for a vehicle component, and a method of forming a pre-oxidized steel sheet. The pre-oxidized steel sheet includes a surface, a bulk region beneath the surface, and an oxide layer disposed on the surface. The oxide layer exhibits a thickness in the range of 20 nanometers to 60 nanometers and includes at least one of a manganese oxide, an iron oxide, a manganese iron oxide, a chromium oxide, and an amorphous silicon oxide.

6 Claims, 4 Drawing Sheets

(51) Int. Cl.
*C23C 8/10* (2006.01)
*C21D 1/673* (2006.01)

(56) References Cited

FOREIGN PATENT DOCUMENTS

| | | | | | |
|---|---|---|---|---|---|
| EP | 4578986 | A1 * | 7/2025 | ..... | C21D 8/02 |
| WO | WO-2024043606 | A1 * | 2/2024 | ..... | C21D 8/02 |

OTHER PUBLICATIONS

Zhao Li, et al., "Oxidation mechanisms of a CrSi alloyed coating-free press-hardened steel under simulated press hardening conditions," Materials Characterization, Dec. 2023, pp. 1-13, vol. 206, Part A, 113446.
Zhisong Chai, et al., "Cr-enriched carbide induced stabilization of austenite to improve the ductility of a 1.7GPA-press-hardened steel," Scripta Materialia, Feb. 2023, pp. 1-5, vol. 224, 115108.

* cited by examiner

PRE-OXIDIZED, COATING-FREE PRESS HARDENED STEEL

BACKGROUND

Press hardened steel sheet is commonly used in various applications, including structural components for vehicle bodies. Applications include bumper beams, pillars, panels, rails/members and door beams. The steel is provided as thin coiled sheet having a thickness that is often in the range of 0.5 millimeters to 4.0 millimeters. The coiled sheet is cut, trimmed, and hot stamped into desired shapes.

Various coatings have been used to protect steel sheet from corrosion and high temperature oxidation during transportation and press-hardening. Examples of such coatings include hot-dip galvanized coatings and aluminum silicon coatings. Hot-dip galvanization provides a zinc layer on the surface of the steel sheet that bonds with the iron in the steel near the interface of the zinc layer and steel sheet. The coating protects the steel from corrosion and increases abrasion resistance during stamping or other manufacturing processes. Aluminum silicon coatings provide a layer of aluminum and silicon on the surface of steel sheet. Aluminum silicon coatings are also applied to steel sheet before press hardening to protect the steel from oxidation during the press hardening in addition to providing corrosion resistance. Similarly, aluminum-zinc coatings, optionally including silicon to increase adhesion, may be used to protect steel in steel sheet from oxidation. However, when such coatings are present on steel surfaces during welding or brazing, the coatings introduce impurities into weld joints and may negatively impact the mechanical properties of the joints. Thus, the coatings are preferably removed from joining surfaces in some applications prior to welding or brazing using mechanical abrasion, chemical removal, laser ablation, or other methods.

Thus, while present coatings used on steel sheet achieve their intended purpose, there is a need for new and improved steel sheets and methods of forming steel sheets for protecting the steel sheet surface from oxidation and corrosion before and during the press hardening process.

SUMMARY

According to various aspects, the present disclosure relates to a pre-oxidized steel sheet for press hardening. The pre-oxidized steel sheet includes a surface, a bulk region beneath the surface, and an oxide layer disposed on the surface. The bulk region includes a steel composition including carbon (C) present in the range of 0.05 weight percent to 0.35 weight percent of the total weight percent of the composition, manganese (Mn) present in the range of 0.5 weight percent to 5.0 weight percent of the total weight percent of the composition, silicon (Si) present in the range of 0.5 weight percent to 2.0 weight percent of the total weight percent of the composition, chromium (Cr) present in the range of 0.6 weight percent to 4.0 weight percent of the total weight percent of the composition, optionally niobium (Nb) present in the range of 0.02 weight percent to 0.05 weight percent of the total weight percent of the composition, and iron present in the remainder of the composition to provide a total weight percent of 100 percent. In addition, the oxide layer includes at least one of a manganese oxide, an iron oxide, a manganese iron oxide, a chromium oxide, and an amorphous silicon oxide. Further, the oxide layer exhibits a thickness in the range of 20 nanometers to 60 nanometers.

In embodiments of the above, the pre-oxidized steel sheet further includes a subsurface depletion zone between the bulk region and the surface, wherein the subsurface depletion zone exhibits a thickness of less than 0.7 micrometers and includes manganese present in the range of 25 percent to 50 percent of the amount of manganese in the bulk region.

In any of the above embodiments, the oxide layer includes a relative weight percent ratio of $MnFe_2O_4$ to $Fe_2O_3$ in the range of 1:1 to 5:1.

In any of the above embodiments, the oxide layer includes a relative weight percent ratio of $Mn_2O_3$ to $MnFe_2O_4$ in the range of 0.35:1 to 3:1.

According to various additional aspects, the present disclosure relates to a press hardened, pre-oxidized steel sheet for a vehicle component. The press hardened, pre-oxidized steel sheet includes a surface, a bulk region beneath the surface, and an oxide layer disposed on the surface. The a bulk region beneath the surface includes a steel composition including carbon (C) present in the range of 0.05 weight percent to 0.35 weight percent of the total weight percent of the composition, manganese (Mn) present in the range of 0.5 weight percent to 5.0 weight percent of the total weight percent of the composition, silicon (Si) present in the range of 0.5 weight percent to 2.0 weight percent of the total weight percent of the composition, chromium (Cr) present in the range of 0.6 weight percent to 4.0 weight percent of the total weight percent of the composition, optionally niobium (Nb) present in the range of 0.02 weight percent to 0.05 weight percent of the total weight percent of the composition, and iron present in the remainder of the composition to provide a total weight percent of 100 percent. In addition, the oxide layer includes at least one of a manganese oxide, an iron oxide, a manganese iron oxide, a chromium oxide, and an amorphous silicon oxide. Further the oxide layer exhibits a thickness in the range of 60 nanometers to 1 micrometer.

In embodiments of the above, the bulk region exhibits a martensitic structure present in the range of 85 to 99.8 percent by volume of the total volume of the bulk region with austenite present in the range of 0.1 to 8 percent by volume of the total volume of the bulk region and carbide phases present in the range of 0.1 to 7 percent by volume of the total volume of the bulk region, wherein the total volume of the bulk region is 100 percent. In further embodiments, the carbide phases are enriched with chromium and the chromium content of the carbide phases is in the range of 5 weight percent to 51 weight percent of the carbide phases, the remainder, totaling 100 weight percent being carbon.

In any of the above embodiments, the press hardened, pre-oxidized steel sheet component exhibits a yield strength in the range of 1,000 Megapascals to 1,500 Megapascals, an ultimate tensile strength in the range of 1,400 Megapascals to 1,900 Megapascals, and a total elongation in the range of 5 percent to 10 percent.

According to various additional aspects, the present disclosure relates to a method of forming a pre-oxidized steel sheet for a vehicle component. The method includes heating a steel sheet in a first process environment at a pre-oxidization temperature in the range of 600 degrees Celsius to 850 degrees Celsius for a pre-oxidation time period in the range of 0.1 seconds to 1,000 seconds. The method further includes forming an oxide layer on a surface of the steel sheet exhibiting a thickness in the range of 20 nanometers to 60 nanometers on a surface of the steel sheet. The steel sheet includes the following steel composition: carbon (C) present in the range of 0.05 weight percent to 0.35 weight percent of the total weight percent of the composition, manganese (Mn) present in the range of 0.5 weight percent to 5.0 weight percent of the total weight percent of the composition, silicon (Si) present in the range of 0.5 weight percent to 2.0 weight percent of the total weight percent of the composition, chromium (Cr) present in the range of 0.6 weight percent to 4.0 weight percent of the total weight percent of the composition, optionally niobium (Nb) present in the range of 0.02 weight percent to 0.05 weight percent of the total weight percent of the composition, and iron present in the remainder of the composition to provide a total weight percent of the composition of 100 percent. The oxide layer includes at least one of a manganese oxide, an iron oxide, a manganese iron oxide, a chromium oxide, and an amorphous silicon oxide. The method provides a pre-oxidized steel sheet.

In embodiments of the above, the method further includes exposing the steel sheet to air in the first process environment.

In any of the above embodiments, the method further includes exposing the steel sheet in the first process environment to dry air exhibiting a first dew point in the range of minus 40 degrees Celsius to 50 degrees Celsius.

In any of the above embodiments, the method further includes exposing the steel sheet in the first process environment to moisture and at least one of nitrogen, hydrogen, and carbon monoxide, wherein the moisture in the process environment provides the oxygen to form the oxide layer.

In any of the above embodiments, the method further includes forming a subsurface depletion zone between a bulk region below the surface and the surface. In further embodiments, the method includes forming the subsurface depletion zone to a thickness in the range of 0.01 to 0.7 micrometers and includes manganese present in the range of 25 percent to 50 percent of the amount of manganese in the bulk region.

In any of the above embodiments, the method further includes annealing the steel sheet concurrently with heating the steel sheet.

In any of the above embodiments, the steel sheet includes an oil layer and the method further comprises burning the oil layer off of the steel sheet.

In any of the above embodiments, the method further includes heating the pre-oxidized steel sheet to a press hardening temperature in the range of 850 degrees Celsius to 1200 degrees Celsius in a second process environment. In further embodiments, the method includes exposing the pre-oxidized steel sheet to air in the second process environment. In yet further embodiments, the method includes exposing the pre-oxidized steel sheet to dry air exhibiting a first dew point in the range of minus 40 degrees Celsius to 10 degrees Celsius in the second process environment.

In any of the above embodiments, the method further includes pressing the pre-oxidized steel sheet in a die after heating and quenching the pre-oxidized steel sheet at a cooling rate in the range of 20 degrees Celsius per second to 200 degrees Celsius per second.

BRIEF DESCRIPTION OF DRAWINGS

The drawings described herein are for illustration purposes only and are not intended to limit the scope of the present disclosure in any way.

DETAILED DESCRIPTION

Figure 1:
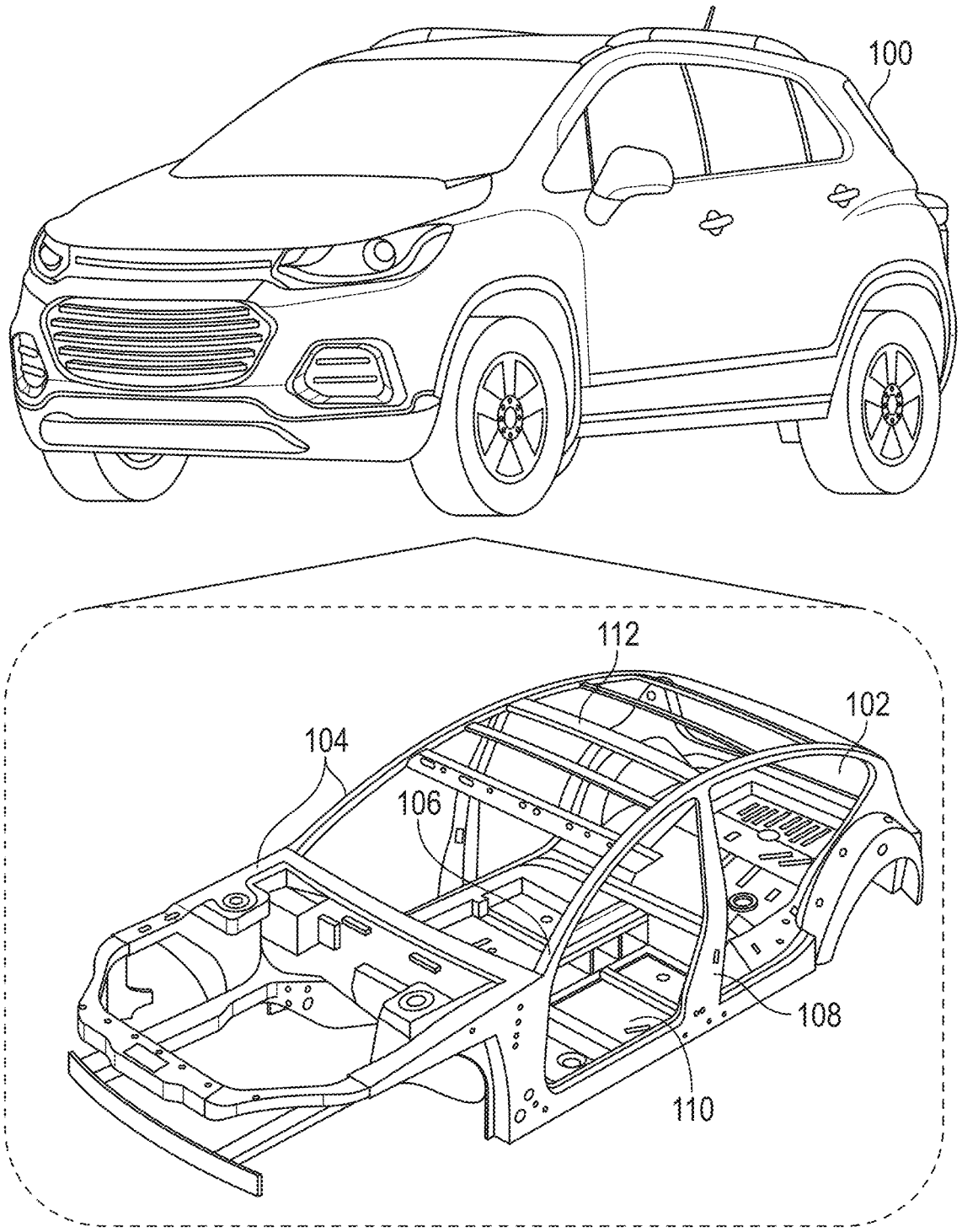
FIG. 1 illustrates a vehicle according to embodiments of the present disclosure.

The following description is merely exemplary in nature and is not intended to limit the present disclosure, application, or uses. Furthermore, there is no intention to be bound by any expressed or implied theory presented in the preceding introduction, summary, or the following detailed description. It should be understood that throughout the drawings, corresponding reference numerals indicate like or corresponding parts and features.

Reference will now be made in detail to several examples of the disclosure that are illustrated in accompanying drawings. Whenever possible, the same or similar reference numerals are used in the drawings and the description to refer to the same or like parts or steps. The drawings are in simplified form and are not to precise scale, except as otherwise noted.

The present disclosure relates to pre-oxidized, coating-free steel sheet for use in press hardened steel applications, press hardened, pre-oxidized coating-free steel sheets for use in vehicle components, methods of forming pre-oxidized, coating-free steel sheets, and methods of press hardening pre-oxidized coating-free steel sheets. It should be appreciated that a coating-free steel sheet is understood as steel sheet that does not include coatings containing at least one of aluminum, zinc, and silicon that are applied prior to the press hardening process. Oil, however, may be present on the steel sheet prior to pre-oxidation to inhibit rust formation. Additionally or alternatively, oil may be coated on the steel sheet after pre-oxidation to inhibit rust formation prior to press hardening. It should also be appreciated that press hardening refers to hot stamping, hot press forming, or hot forming die quenching, and hot blow forming. The pre-oxidized, coating-free steel sheet is press hardened to form various structural and non-structural components for vehicle applications, including but not limited to bumper beams, pillars such as the A, B, or C pillar, panels, rails/members, door intrusion beams, and battery enclosures. In addition, the present disclosure relates to methods and systems for forming the pre-oxidized, coating-free steel sheet and press hardening the pre-oxidized, coating-free steel sheet.

As used herein, the term "vehicle" is not limited to automobiles. While the present technology is described primarily herein in connection with automobiles, the technology is not limited to automobiles. The concepts can be used in a wide variety of applications, such as in connection with motorcycles, mopeds, locomotives, aircraft, marine craft, and other vehicles, as well as in other structural components and non-structural components and in thermal joining applications.

FIG. 1 illustrates a non-limiting embodiment of a vehicle 100 including a body frame 102. The body frame 102 is formed from one or more components 104, which are assembled together using press hardened steel blanks of pre-oxidized, coating-free steel sheet. The components 104 forming the body frame 102 include but are not limited to, for example, the A-pillar 106, the B-pillar 108, the floor panel 110, and the roof 112 as well as, for example, bumper beams, door intrusion beams, and battery enclosures.

Figure 2:
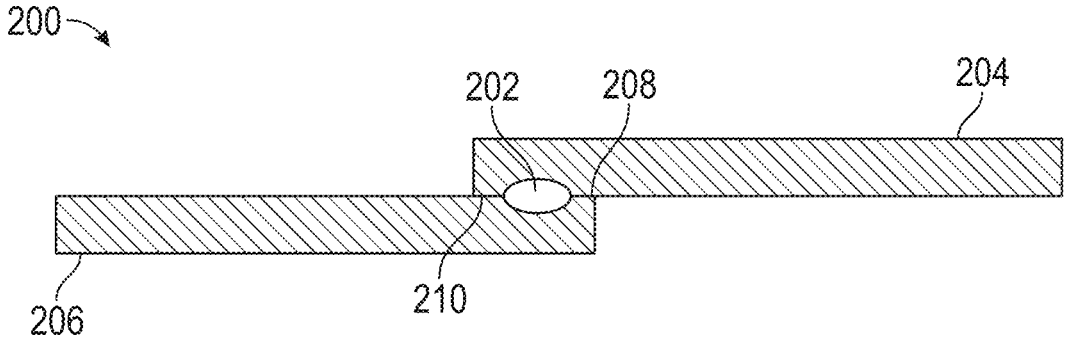
FIG. 2 illustrates a weld joint according to embodiments of the present disclosure.

To assemble the components 104, the components 104 may be joined using one or more thermal processes such as welding or brazing. FIG. 2 illustrates an example of a joint 200 formed using a thermal process. The joint 200 includes a joint interface 202 created by thermally joining two steel sheets 204, 206 at an interface surface 208, 210 on each steel sheet 204, 206. Interface surfaces 208, 210 are those surfaces that form a portion of a joint 200.

Figure 3A:
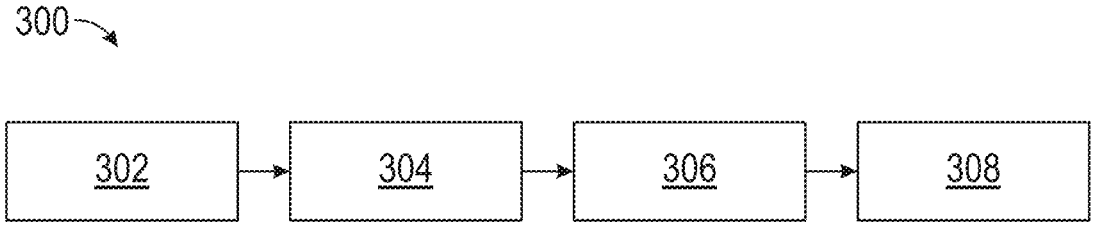
FIG. 3A illustrates a method of pre-oxidizing a steel sheet followed by press hardening according to embodiments of the present disclosure.

A general method 300 of forming a pre-oxidized, coating-free press hardened steel is illustrated in FIG. 3A. In embodiments, the method includes at block 302 casting and rolling the steel sheet. The steel composition includes iron, carbon, manganese, silicon, chromium and optionally niobium. In embodiments, the steel composition includes carbon (C) present in the range of 0.05 weight percent to 0.35 weight percent of the total weight percent of the composition, manganese (Mn) present in the range of 0.5 weight percent to 5.0 weight percent of the total weight percent of the composition, silicon (Si) present in the range of 0.5 weight percent to 2.0 weight percent of the total weight percent of the composition, chromium (Cr) present in the range of 0.6 weight percent to 4.0 weight percent of the total weight percent of the composition, optionally niobium (Nb) present in the range of 0.02 weight percent to 0.05 weight percent of the total weight percent of the composition, and iron present in the remainder of the composition to provide a total weight percent of 100 percent. In further embodiments, the steel sheet consists essentially of carbon (C) present in the range of 0.05 weight percent to 0.35 weight percent of the total weight percent of the composition, manganese (Mn) present in the range of 0.5 weight percent to 5.0 weight percent of the total weight percent of the composition, silicon (Si) present in the range of 0.5 weight percent to 2.0 weight percent of the total weight percent of the composition, chromium (Cr) present in the range of 0.6 weight percent to 4.0 weight percent of the total weight percent of the composition, optionally niobium (Nb) present in the range of 0.02 weight percent to 0.05 weight percent of the total weight percent of the composition, and iron present in the remainder of the composition to provide a total weight percent of 100 percent or, alternatively, consists of carbon (C) present in the range of 0.05 weight percent to 0.35 weight percent of the total weight percent of the composition, manganese (Mn) present in the range of 0.5 weight percent to 5.0 weight percent of the total weight percent of the composition, silicon (Si) present in the range of 0.5 weight percent to 2.0 weight percent of the total weight percent of the composition, chromium (Cr) present in the range of 0.6 weight percent to 4.0 weight percent of the total weight percent of the composition, optionally niobium (Nb) present in the range of 0.02 weight percent to 0.05 weight percent of the total weight percent of the composition, and iron present in the remainder of the composition to provide a total weight percent of 100 percent. It should be appreciated that in any of the above embodiments, unavoidable trace elements may be present and introduced, for example, in the process environment (i.e., the atmosphere surrounding the steel sheet during processing), by the process equipment, or in the feedstocks. In embodiments, the elements of the steel sheet formulation are combined, melted in a furnace, and formed into an ingot that is pressed and formed into a steel sheet. The steel sheet is then passed through a series of rolls to elongate the steel sheet and reduce the thickness of the steel sheet until a desired thickness is reached.

Figure 3B:
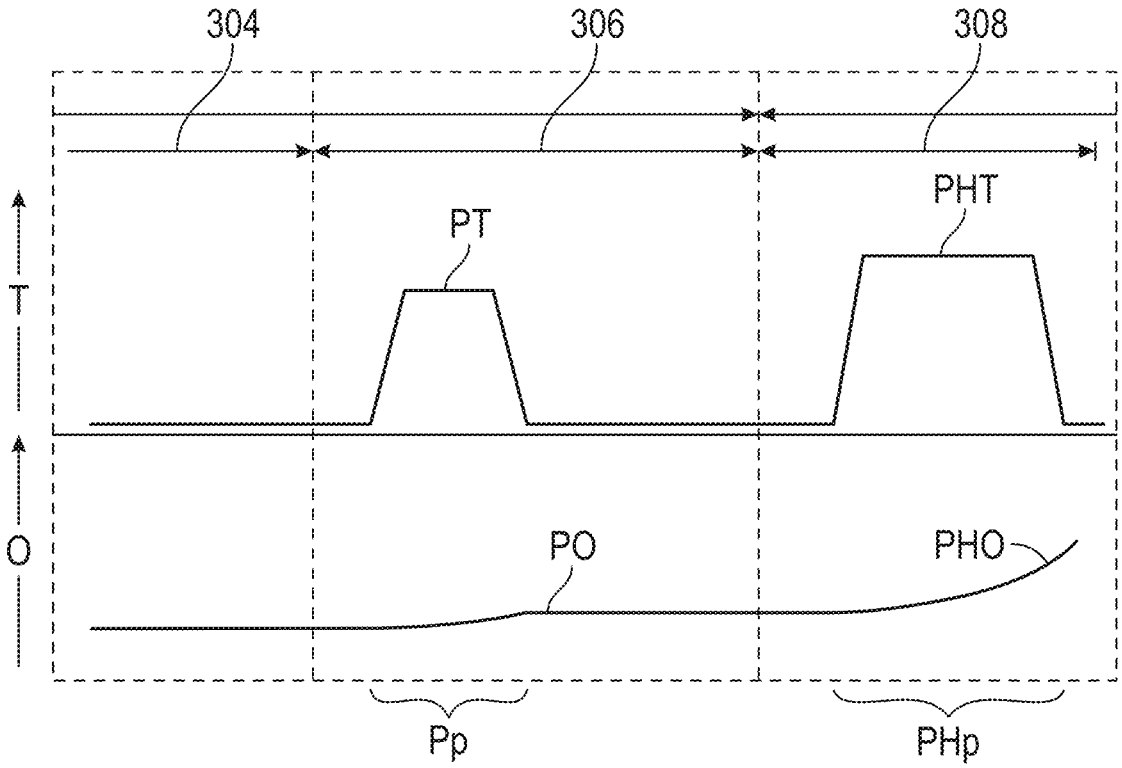
FIG. 3B illustrates the relative temperature T and oxide layer thickness O formation during the method of FIG. 3A according to embodiments of the present disclosure.
Figure 4A:
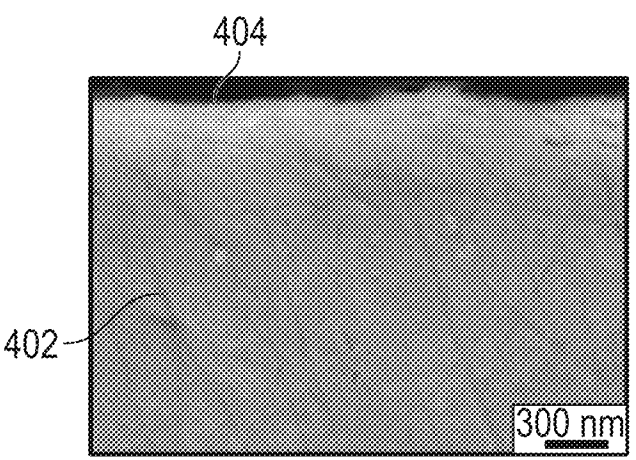
FIG. 4A illustrates a scanning electron microscope image of a cross-section of a steel sheet after pickling. The scale is 300 nanometers (nm) long.

At block 304, the steel sheet is optionally pickled by passing the sheet through one or more tanks including a pickling liquor to remove impurities, rust, scale, or other impurities from the steel sheet surfaces. The pickling liquor includes an acid such as hydrochloric acid, sulfuric acid, hydrochloric-sulfuric acid, and phosphoric acid pickling. In alternative embodiments, eco-pickled surface (EPS) and automated brush scrubbing are used for removal of mill oxides. FIG. 3B illustrates that, in embodiments, pickling may be performed at temperatures of less than 100 degrees Celsius, such as in the range of 21 degrees Celsius to 100 degrees Celsius. At the end of pickling, the steel sheet is optionally oiled to form an oil layer on the steel sheet, which helps in preventing rust formation. A scanning electron microscope image of a cross-section of a pickled steel sheet 400 is illustrated in FIG. 4A. As seen in the micrograph, there is little, if any, oxidation on the surface 404 of the pickled steel sheet 400.

At block 306 the optionally picked and oiled, steel sheet is pre-oxidized. As illustrated in FIG. 3B, the pre-oxidation process at block 306 occurs by heating the steel sheet, that is coating-free, at a pre-oxidation temperature PT below the transformation temperature Ac1 of the steel composition. The transformation temperature Ac1 is understood as the lower critical temperature of the steel sheet, that is, the temperature in which the steel begins to transform from ferrite to austenite. In embodiments, the steel sheet is heated at a temperature that is sufficient to anneal the steel sheet, which is understood to cause reordering of the crystalline structures in the steel sheet. In further embodiments, the pre-oxidation process occurs at a pre-oxidation temperature PT in the range of 600 degrees Celsius to 850 degrees Celsius, including all values and ranges therein such as 760 degrees Celsius. Further, the steel sheet is exposed to pre-oxidation temperatures for a pre-oxidation time period (Pp) in the range of 0.1 seconds to 1,000 seconds, including all values and ranges therein. In embodiments, the cooling rate of the steel sheet after pre-oxidization is in the range of 1 degrees Celsius per second to 100 degrees Celsius per second, including all values and ranges therein.

The pre-oxidation process occurs in an oven or other semi-enclosed or, preferably, closed environment, providing a first process environment. The first process environment during pre-oxidation includes at least one of air from the surrounding atmosphere, dry air having a dew point in the range of minus 40 degrees Celsius to 50 degrees Celsius including all values and ranges therein, such as in the range of 20 degrees Celsius to 30 degrees Celsius. In alternative embodiments, nitrogen, hydrogen, carbon monoxide, and mixtures thereof may be used in the first process environment. When oxygen is not present in the first process environment, moisture provides a sufficient amount of oxygen for oxidization. In embodiments, the process is a continuous process. If the steel sheet was oiled during the pickling process at block 304, the oil burns off during the pre-oxidization process. As alluded to above, the pre-oxidization process may be combined with annealing or other heat treatment methods that may occur concurrently with pre-oxidation after hot/cold rolling and optional pickling and oiling.

Figure 4B:
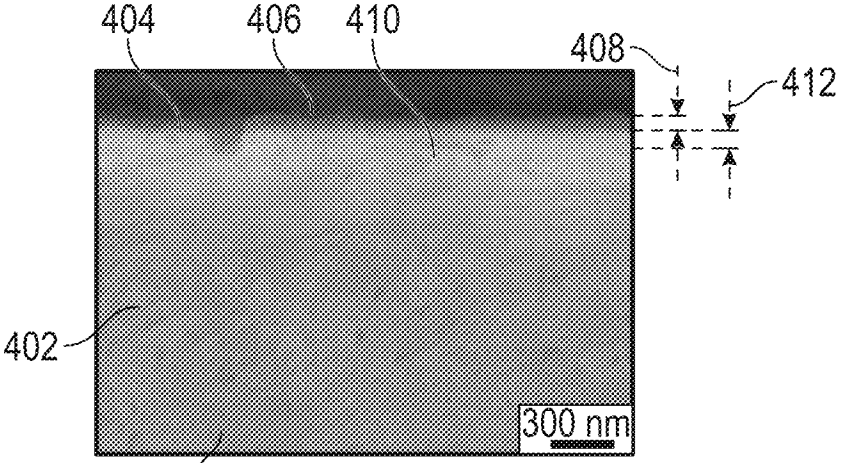
FIG. 4B illustrates a scanning electron microscope image of a cross-section of a pre-oxidized steel sheet without a coating. The scale is 300 nanometers (nm) long.

During the pre-oxidization process, and as illustrated in FIG. 4B, the steel sheet 402 develops an oxide layer 406 disposed on the surface 404. In embodiments, the thickness 408 of the oxide layer 406 is in the range of 20 nanometers to 60 nanometers, including all values and ranges therein, across at least 90 percent of the area of the surface 404. The oxide structure in the oxide layer 406 includes, but is not limited to, manganese oxides including $Mn_2O_3$, iron oxides including $Fe_2O_3$, manganese iron oxides including $MnFe_2O_4$, and chromium oxides including CrO and $Cr_2O_3$, and amorphous silicon oxides including $SiO_2$. The relative weight percent ratio of $MnFe_2O_4$ to $Fe_2O_3$ is 1:1 or greater, such as in the range of 1:1 to 5:1, including all values and ranges therein. The relative weight percent ratio of $Mn_2O_3$ to $MnFe_2O_4$ is 0.35:1 or greater, such as in the range of 0.35:1 to 3:1, including all values and ranges therein. The relative weight percent ratios being determined by energy dispersive X-ray spectroscopy.

In addition, in embodiments, a subsurface depletion zone 410 develops beneath the surface 404 of the steel sheet 402. The subsurface depletion zone 410 has a thickness 412 of less than 0.7 micrometers, including all values and ranges of 0.01 to 0.7 micrometers, from the surface 404 of the steel sheet 402 in which the amount of manganese is less than 50 percent of the amount of manganese exhibited by the bulk region 414 of the steel sheet 402 below the subsurface depletion zone 410, including all values and ranges from 25 percent by weight to 50 percent by weight of the amount of manganese present in the bulk region 414. The bulk region 414 includes the initial steel composition used to form the steel sheet 402 described above at block 302. FIG. 3B illustrates the development of oxide layer 406 growth in thickness PO during the pre-oxidation process at block 306. As illustrated, during the pre-oxidation process, the oxide layer 406 grows to a given thickness PO until the temperature is reduced to a temperature of less than 200 degrees Celsius, including all values and ranges therein, such as from 21 degrees Celsius to 200 degrees Celsius.

Figure 5:
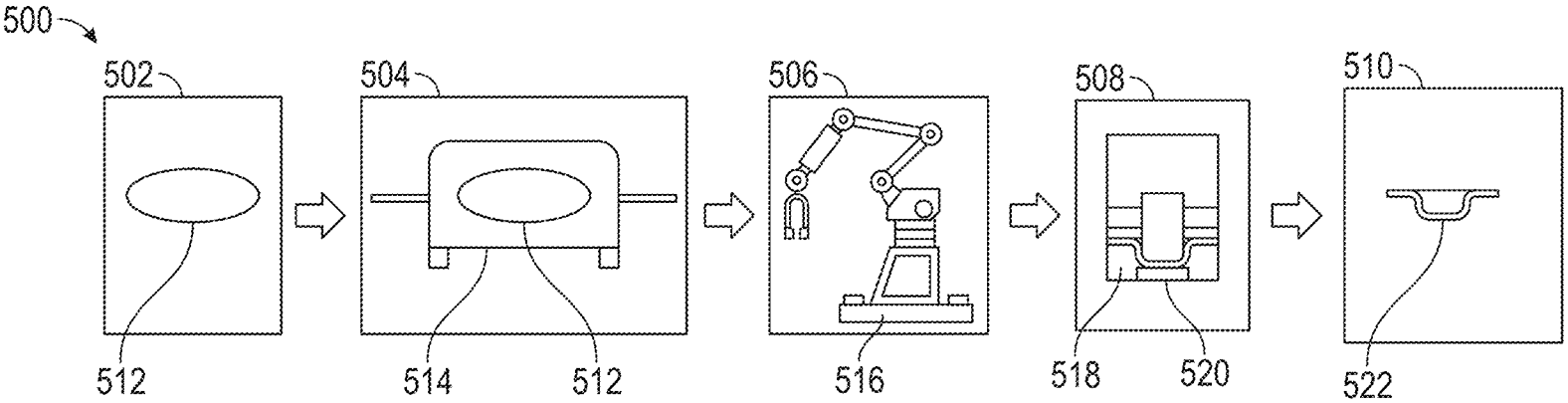
FIG. 5 illustrates an example of a press hardening process according to embodiments of the present disclosure.

At block 308 the pre-oxidized, steel sheet is press hardened. Again, at this point, the steel sheet remains coating-free. FIG. 5 illustrates an embodiment of a process 500 for press hardening the steel sheet. At block 502 the steel sheet, which is typically supplied in a coil, is cut into a blank 512, often a generally flat geometric shape. While an oblong shape is illustrated, the blank 512 may exhibit any shape including, but not limited to circular, rounded elongate shapes, or polygonal shapes including three or more sides. Optionally, in embodiments, the blank 512 may also be treated through at least one of the following processes: cold forming, trimming, and piercing. Optionally, pre-oxidized coil is roll formed, welded, and cut into tubular shape.

At block 504 the steel sheet blank 512 is heated, as illustrated in FIG. 3B, to a press hardening temperature PHT above the transformation temperature Ac3, which is at or above the upper critical temperature of the steel sheet in which the steel sheet fully transforms from ferrite to austenite during heating. In embodiments, the press hardening temperature is in the range of 850 degrees Celsius to 1,200 degrees Celsius, including all values and ranges therein, such as 930 degrees Celsius. In embodiments, heating occurs for a press hardening time period (PHp) in the range of 10 second to 1000 seconds including all values and ranges therein. In embodiments, a tunnel furnace or a muffle furnace can be used for heating steel sheet blank 512 with heating rate between 1 degrees Celsius per second and 20 degrees Celsius per second. In alternative or additional embodiments, induction heating can be used to obtain heating rate between 20 degrees Celsius per second and 1000 degrees Celsius per second. The second process environment includes air, such as air from the surrounding atmosphere or treated air having a reduced dew point such as in the range of 40 degrees Celsius to 10 degrees Celsius, including all values and ranges therein.

At block 506 the heated steel sheet blank 512 is transferred to the die 518 of a press using a robot or conveyor 516. In the die 518, at block 508, the heated steel sheet blank 512 is pressed into the general shape of the die 518 cavity 520 and formed into the general shape of a component, such as an A-pillar, bumper beam, etc. In addition, during pressing, the steel sheet blank 512 is quenched. The cooling rate of the steel sheet blank 512 is in the range of 20 degrees Celsius per second to 200 degrees Celsius per second, including all values and ranges therein. The die 518 is cooled by circulating a heat transfer fluid through channels or other openings in the die 518. The heat transfer fluid includes, for example, water or oil. Pressing and quenching are applied for a time period in the range of 3 seconds to 15 seconds, including all values and ranges therein. At block 510 the component 522 formed from the steel sheet blank 512 is removed from the die 518. Optionally, the component is formed by air quenching without using a die.

Figure 4C:
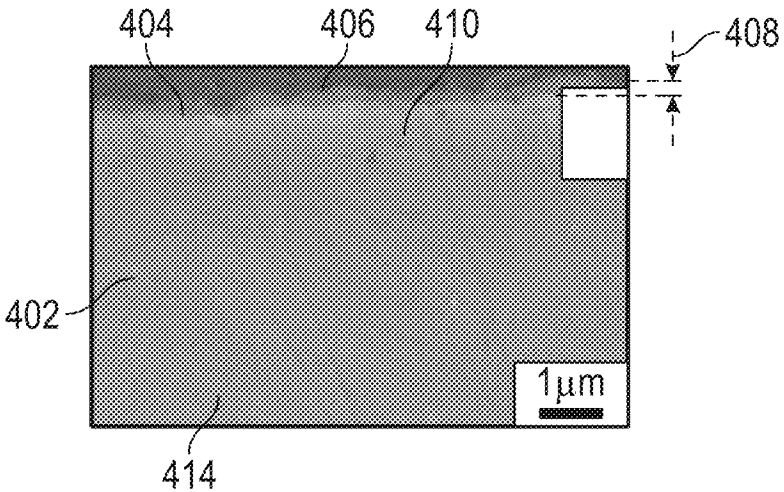
FIG. 4C illustrates a scanning electron microscope image of a cross-section of a pre-oxidized steel sheet without a coating after press hardening. The scale is 1 micrometer (μm) long.

FIG. 3B illustrates the relative growth in the thickness PHO of the oxide layer 406 of the pre-oxidized steel sheet after the press hardening process of block 308. As illustrated, the oxide layer 406 may continue to grow through heating and cooling. FIG. 4C illustrates an embodiment of the oxide layer 406 after press hardening. The oxide layer 406 is less than 1 micrometer in thickness 408, including all values and ranges from 60 nanometers to 1 micrometer in thickness 408, and in preferred embodiments the oxide layer 406 is in the range of 60 nanometers to 0.4 micrometers, across at least 90 percent of the area of the surface 404. At this thickness 408, the oxide layer 406 is not understood to interfere with spot welding or painting. In addition, after press hardening, the steel sheet of the component 522 exhibits in the bulk region a martensitic structure present in the range of 85 to 99.8 percent by volume of the total volume with austenite present in the range of 0.1 to 8 percent by volume of the total volume and carbide phases present in the range of 0.1 to 7 percent by volume of the total volume, wherein the total volume is 100 percent and the austenite is measured by X-ray diffraction and carbide is measured by transmission electron microscopy. The carbide phases include transition metal carbides, wherein in the transition metals may include, for example, iron, manganese, silicon, carbon, and chromium. In embodiments, the carbide phases are enriched with chromium and the chromium content is in the range of 5 weight percent to 51 weight percent of the carbide phases, including all values and ranges therein, such as from 25 weight percent to 50 weight percent of the carbide phases.

The press hardened, pre-oxidized steel sheet exhibits a yield strength in the range of 1,000 Megapascals to 1,500 Megapascals, including all values and ranges therein. In addition, the ultimate tensile strength of the press hardened, pre-oxidized steel sheet is in the range of 1,400 Megapascals to 1,900 Megapascals, including all values and ranges therein. Further, the total elongation of the press hardened, pre-oxidized steel sheet is in the range of 5 percent to 10 percent, including all values and ranges therein. The testing procedure used herein was ASTM E8 standard using A50 samples.

Figure 4D:
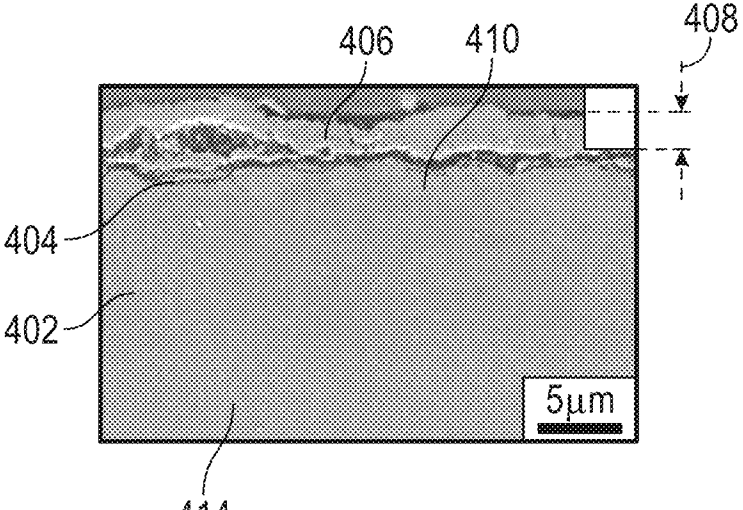
FIG. 4D illustrates a scanning electron microscope image of a cross-section of a steel sheet that has not been pre-oxidized and without a coating after press hardening. The scale is 5 micrometers (μm) long.

Comparatively, FIG. 4D illustrates the resulting oxide layer if pre-oxidation is not performed at block 306 prior to press hardening at block 308 and without the application of a coating, such as zinc, aluminum, or silicon coatings prior to press-hardening. As illustrated, the steel sheet 402 exhibits an oxide layer 406 on the surface 404 of the steel sheet 402 that is about 5 micrometers in thickness 408. This oxide layer 406 may exhibit spalling or other detrimental properties. In addition, the region 418 beneath the surface 404, a relatively thick layer of internal oxidation or intergranular oxidation forms, illustrated by the web or net like features beneath the surface 404. The internal oxidation is understood to potentially have a detrimental impact on the spot weldability of the steel sheet 402. In the region 420 beneath the surface 404 of the press hardened, pre-oxidized steel sheet, illustrated in FIG. 4C, little to no internal oxidation is present and if any oxidation is present, it is present in less than 1 micrometer of thickness.

Figure 6B:
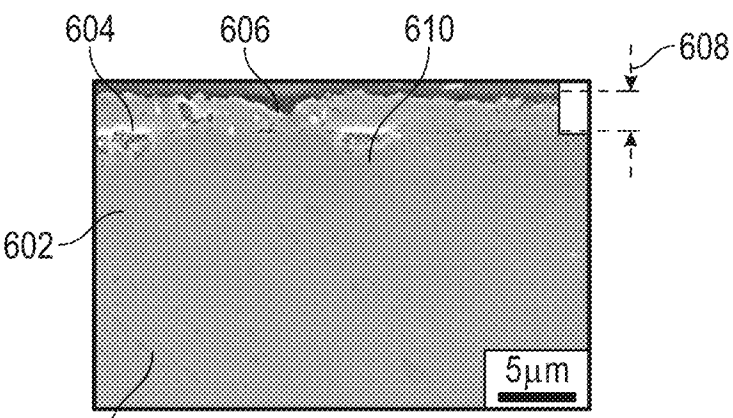
FIG. 6B illustrates a scanning electron microscope image of a cross-section of a pre-oxidized steel sheet after press hardening that had an overdeveloped pre-oxidation layer before press hardening. The scale is 5 micrometers.
Figure 6A:
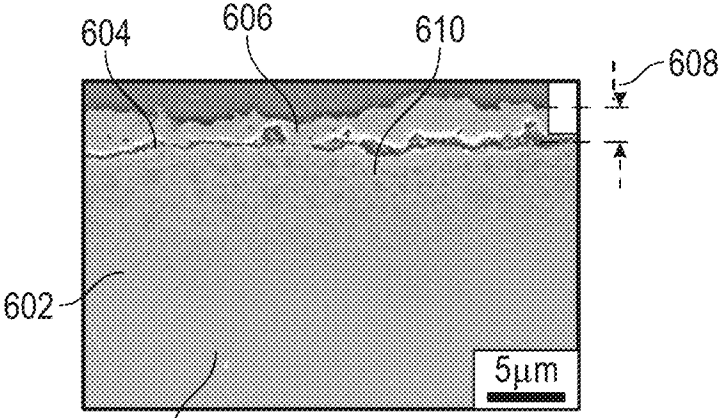
FIG. 6A illustrates a scanning electron microscope image of a cross-section of a pre-oxidized steel sheet after press hardening that had an underdeveloped pre-oxidation layer before press hardening. The scale is 5 micrometers.

It was found that forming an insufficient oxide layer having a thickness 408 of less than 20 nanometers or an overdeveloped oxide layer having thickness of greater than 60 nanometers during pre-oxidation at block 306 resulted in the formation of significantly thicker oxide layers 406 during and after press hardening at block 308. FIG. 6A illustrates the oxide layer 606, after press hardening a steel sheet 602 having a pre-oxidization oxide layer of less than 20 nanometers formed at block 306. The thickness 608 of the oxide layer 606 after press hardening at block 308 is in the range of 3 micrometers to 4 micrometers. In addition, the region 618 beneath the surface 604, a relatively thick layer of internal oxidation or intergranular oxidation forms, illustrated by the web or net like features beneath the surface 604, which is understood to potentially have a detrimental impact on the spot weldability of the steel sheet 602. FIG. 6B illustrates the oxide layer 606, after press hardening a steel sheet 602 having a pre-oxide layer of greater than 60 nanometers at block 306. The thickness 608 of the oxide layer 606 after press hardening at block 308 is in the range of 3 micrometers to 4 micrometers. Further, with the over-development of the oxide layer 606 during pre-oxidation at block 306, the region 618 beneath the surface 604 includes internal oxidation or intergranular oxidation, illustrated by the web or net like features beneath the surface 604, which again is understood to potentially have a detrimental impact the spot weldability of the steel sheet. Under development of the oxide layer 606 during pre-oxidation at block 306 may be due to insufficient pre-oxidation temperatures (PT), insufficient pre-oxidation time (Pp), or both. Over development of the oxide layer 606 during pre-oxidation at block 306 may be due to the use of too high pre-oxidation temperatures (PT), too much pre-oxidation time (Pp), or both.

The pre-oxidized steel sheet, press hardened, pre-oxidized steel sheet, press hardened, pre-oxidized steel sheet component for a vehicle, and methods herein offer a number of advantages. These advantages include high temperature oxidation resistance and the elimination of the need for an inert environment, such as a nitrogen atmosphere, during the press hardening process. In addition, these advantages include the ability to spot weld and paint the press hardened steel sheet without interference by the oxide layer. These advantages also include, for example, the ability to omit coatings on the steel sheet, such as aluminum-silicon or zinc coatings, which may weaken weld joints if not removed. Another advantage includes combining the pre-oxidation process with annealing, which may be performed while the steel sheet is still at the steel mill. A further advantage is that the steel may be placed into an induction furnace without removal of coatings that may melt in the induction furnace. Yet a further advantage is the option to use air or dry air in the press-hardening process environment and not be restricted to using inert nitrogen or hydrogen process environments.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A pre-oxidized steel sheet for press hardening, comprising:

a surface;

a bulk region beneath the surface, the bulk region comprising a steel composition including carbon (C) present in the range of 0.05 weight percent to 0.35 weight percent of the total weight percent of the composition, manganese (Mn) present in the range of 0.5 weight percent to 5.0 weight percent of the total weight percent of the composition, silicon (Si) present in the range of 0.5 weight percent to 2.0 weight percent of the total weight percent of the composition, chromium (Cr) present in the range of 0.6 weight percent to 4.0 weight percent of the total weight percent of the composition, optionally niobium (Nb) present in the range of 0.02 weight percent to 0.05 weight percent of the total weight percent of the composition, and iron present in the remainder of the composition to provide a total weight percent of 100 percent;

an oxide layer disposed on the surface, the oxide layer comprising at least one of a manganese oxide, an iron oxide, a manganese iron oxide, a chromium oxide, and an amorphous silicon oxide, the oxide layer exhibiting a thickness in the range of 20 nanometers to 60 nanometers; and a subsurface depletion zone between the bulk region and the surface, wherein the subsurface depletion zone exhibits a thickness of less than 0.7 micrometers and includes manganese present in the range of 25 percent to 50 percent of the amount of manganese in the bulk region.

2. The pre-oxidized steel sheet of claim 1, wherein the oxide layer includes a relative weight percent ratio of $MnFe_2O_4$ to $Fe_2O_3$ in the range of 1:1 to 5:1.

3. The pre-oxidized steel sheet of claim 1, wherein the oxide layer includes a relative weight percent ratio of $Mn_2O_3$ to $MnFe_2O_4$ in the range of 0.35:1 to 3:1.

4. A press hardened, pre-oxidized steel sheet for a vehicle component, comprising:

a surface;

a bulk region beneath the surface, the bulk region comprising a steel composition including carbon (C) present in the range of 0.05 weight percent to 0.35 weight percent of the total weight percent of the composition, manganese (Mn) present in the range of 0.5 weight percent to 5.0 weight percent of the total weight percent of the composition, silicon (Si) present in the range of 0.5 weight percent to 2.0 weight percent of the total weight percent of the composition, chromium (Cr) present in the range of 0.6 weight percent to 4.0 weight percent of the total weight percent of the composition, optionally niobium (Nb) present in the range of 0.02 weight percent to 0.05 weight percent of the total weight percent of the composition, and iron present in the remainder of the composition to provide a total weight percent of 100 percent; and an oxide layer disposed on the surface, the oxide layer comprising at least one of a manganese oxide, an iron oxide, a manganese iron oxide, a chromium oxide, and an amorphous silicon oxide, the oxide layer exhibiting a thickness in the range of 60 nanometers to 1 micrometer, wherein the bulk region exhibits a martensitic structure present in the range of 85 to 99.8 percent by volume of the total volume of the bulk region with austenite present in the range of 0.1 to 8 percent by volume of the total volume of the bulk region and carbide phases present in the range of 0.1 to 7 percent by volume of the total volume of the bulk region, wherein the total volume of the bulk region is 100 percent.

5. The press hardened, pre-oxidized steel sheet of claim 4, wherein the carbide phases are enriched with chromium and a chromium content of the carbide phases is in the range of 5 weight percent to 51 weight percent of the carbide phases.

6. The press hardened, pre-oxidized steel sheet of claim 4, wherein the press hardened, pre-oxidized steel sheet component exhibits a yield strength in the range of 1,000 Megapascals to 1,500 Megapascals, an ultimate tensile strength in the range of 1,400 Megapascals to 1,900 Megapascals, and a total elongation in the range of 5 percent to 10 percent.

* * * * *